US010987795B2

(12) United States Patent
Sergyeyenko et al.

(10) Patent No.: US 10,987,795 B2
(45) Date of Patent: Apr. 27, 2021

(54) DRILL WITH SCREW HOLDER

(71) Applicant: BLACK & DECKER INC., New Britain, CT (US)

(72) Inventors: Oleksiy Sergyeyenko, Baldwin, MD (US); Sean Bailey, Towson, MD (US)

(73) Assignee: Black & Decker Inc., New Britain, CT (US)

( * ) Notice: Subject to any disclaimer, the term of this patent is extended or adjusted under 35 U.S.C. 154(b) by 636 days.

(21) Appl. No.: 15/601,198

(22) Filed: May 22, 2017

(65) Prior Publication Data

US 2018/0281168 A1 Oct. 4, 2018

Related U.S. Application Data

(60) Provisional application No. 62/477,463, filed on Mar. 28, 2017.

(51) Int. Cl.
*B25F 5/02* (2006.01)
*B25B 23/12* (2006.01)
*B25F 3/00* (2006.01)

(52) U.S. Cl.
CPC ..... *B25F 5/027* (2013.01); *B25B 23/12* (2013.01); *B25F 3/00* (2013.01); *B25F 5/02* (2013.01)

(58) Field of Classification Search
CPC .... B25F 5/027; B25F 3/00; B25F 5/02; B25F 5/021; B25B 23/12; B25B 13/48; B25B 13/481; B25B 13/5091; B25B 17/00; B25B 23/08; B25B 21/00; B25B 21/007; B25B 21/002; E21B 19/16; B23P 19/06
USPC ..... 81/52, 82
See application file for complete search history.

(56) References Cited

U.S. PATENT DOCUMENTS 2,388,584 A 6/1942 Longfellow
2,960,131 A * 11/1960 Clark ..... B25B 23/101 81/456
3,728,038 A 4/1973 Gage
3,730,237 A * 5/1973 Hanzlik ..... B25B 23/101 81/456
3,757,407 A * 9/1973 Bomar ..... B23Q 7/10 221/279
5,207,127 A 5/1993 Nick
7,234,376 B2 1/2007 Bader
(Continued)

FOREIGN PATENT DOCUMENTS

CN 104668615 6/2015
DE 102010039581 2/2012
(Continued)

OTHER PUBLICATIONS

EP search report for EP Application No. 18163778.6 dated Aug. 30, 2018.

*Primary Examiner* — Orlando E Aviles
*Assistant Examiner* — Robert F Neibaur
(74) *Attorney, Agent, or Firm* — Stephen R. Valancius

(57) ABSTRACT

A power tool including a housing. A motor is disposed in the housing. The power tool includes an output member, the output member being drivable by the motor. The power tool further includes a holder assembly, the holder assembly including a leg portion extending from the housing and a holder configured to hold at least one of an accessory and a fastener. The holder is rotatable about an axis substantially perpendicular to a rotational axis of the output member.

8 Claims, 14 Drawing Sheets

(56) References Cited

U.S. PATENT DOCUMENTS

| | | | | |
|---|---|---|---|---|
| 8,047,100 | B2 | 11/2011 | King | |
| 8,408,097 | B2 | 4/2013 | Grohmann et al. | |
| 8,821,493 | B2 * | 9/2014 | Anderson | A61B 90/06 606/80 |
| 8,997,887 | B2 * | 4/2015 | Furusawa | B23Q 11/0046 173/198 |
| 10,245,043 | B2 * | 4/2019 | Xie | A61B 90/03 |
| 2009/0193938 | A1 | 8/2009 | Mentor | |
| 2012/0240372 | A1 * | 9/2012 | Nagel, III | B25B 9/00 29/278 |
| 2013/0243538 | A1 | 9/2013 | Hu et al. | |
| 2014/0262409 | A1 | 9/2014 | McRoberts et al. | |
| 2016/0031068 | A1 | 2/2016 | Ma et al. | |
| 2019/0009398 | A1 * | 1/2019 | Zhong | B25B 21/00 |

FOREIGN PATENT DOCUMENTS

| | | |
|---|---|---|
| EP | 2987590 | 2/2016 |
| WO | WO2013026262 | 2/2013 |

* cited by examiner

DRILL WITH SCREW HOLDER

CROSS-REFERENCE TO RELATED APPLICATION

This application claims the benefit of U.S. Provisional Application No. 62/477,463 filed on Mar. 28, 2017, entitled Drill With Screw Holder. The entire contents of U.S. Provisional Application No. 62/477,463 are incorporated herein by reference.

FIELD OF THE INVENTION

The present invention relates to power tools, particularly a drill with bit holder. The drill has a chuck with retractable jaws.

BACKGROUND

There are various existing drills. It is desired to provide a drill with retractable jaws that also provides a screw holder. Screw holders for screwdrivers are known, for example, as shown in U.S. Pat. No. 8,047,100, which is herein incorporated by reference in its entirety.

SUMMARY

According to an aspect of an exemplary embodiment, there is a power tool. The power tool includes a housing. A motor is disposed in the housing. The power tool further including an output member, the output member being drivable by the motor. The power tool also including a holder assembly, the holder assembly including a leg portion extending from the housing and a holder configured to hold at least one of an accessory and a fastener. The holder is rotatable about an axis substantially perpendicular to a rotational axis of the output member.

The output member may include a chuck with a plurality of retractable jaws.

The chuck may be configured to hold screwdriver bits and drill bits of different sizes.

The housing may include a cavity into which the leg is slideable.

The leg may include an outer slider and an inner slider, the inner slider configured to be slideable into the outer slider.

The holder may be disposed at an end of the inner slider.

The holder may include a longitudinally extending groove.

The holder may be biased by a biasing member.

According to another aspect, there is a power tool. The power tool includes a housing. A motor is disposed in the housing. The power tool further including an output member, the output member being drivable by the motor. The power tool also including a holder assembly, the holder assembly including a leg portion a holder configured to hold a fastener. The holder assembly may be movable from a working position in which the leg portion extends from the housing and the holder is disposed in a first orientation in which it is configured to hold the fastener in a position to be driven by a bit held by the output member to a stored position in which the leg portion is slid into the housing and the holder is rotated to a second orientation different than the first orientation.

In the stored position, the holder may be farther away from an axis of rotation of the output member than when the holder is in the working position.

In the stored position, the holder is farther away from an axis of rotation of the motor than when the holder is in the working position.

The holder may rotate about an axis substantially perpendicular to a rotational axis of the output member.

The output member may comprise a chuck with a plurality of retractable jaws.

The chuck may be configured to hold screwdriver bits and drill bits of different sizes.

The housing may include a cavity into which the leg is slideable.

The leg may include an outer slider and an inner slider, the inner slider configured to be slideable into the outer slider.

The holder may be disposed at an end of the inner slider.

According to another aspect, there is an exemplary embodiment of power tool, the power tool including a housing and a motor disposed in the housing. The power tool includes an output member, the output member being drivable by the motor and comprising a chuck with a plurality of retractable jaws. The power tool also includes a holder assembly, the holder assembly including a leg portion a holder configured to hold a fastener. The holder assembly is movable from a working position in which the leg portion extends from the housing and the holder is disposed in a position in which it is configured to hold the fastener in a position to be driven by a bit held by the output member to a stored position in which the leg portion is slid into the housing.

DETAILED DESCRIPTION OF EXEMPLARY EMBODIMENTS

Figure 1:
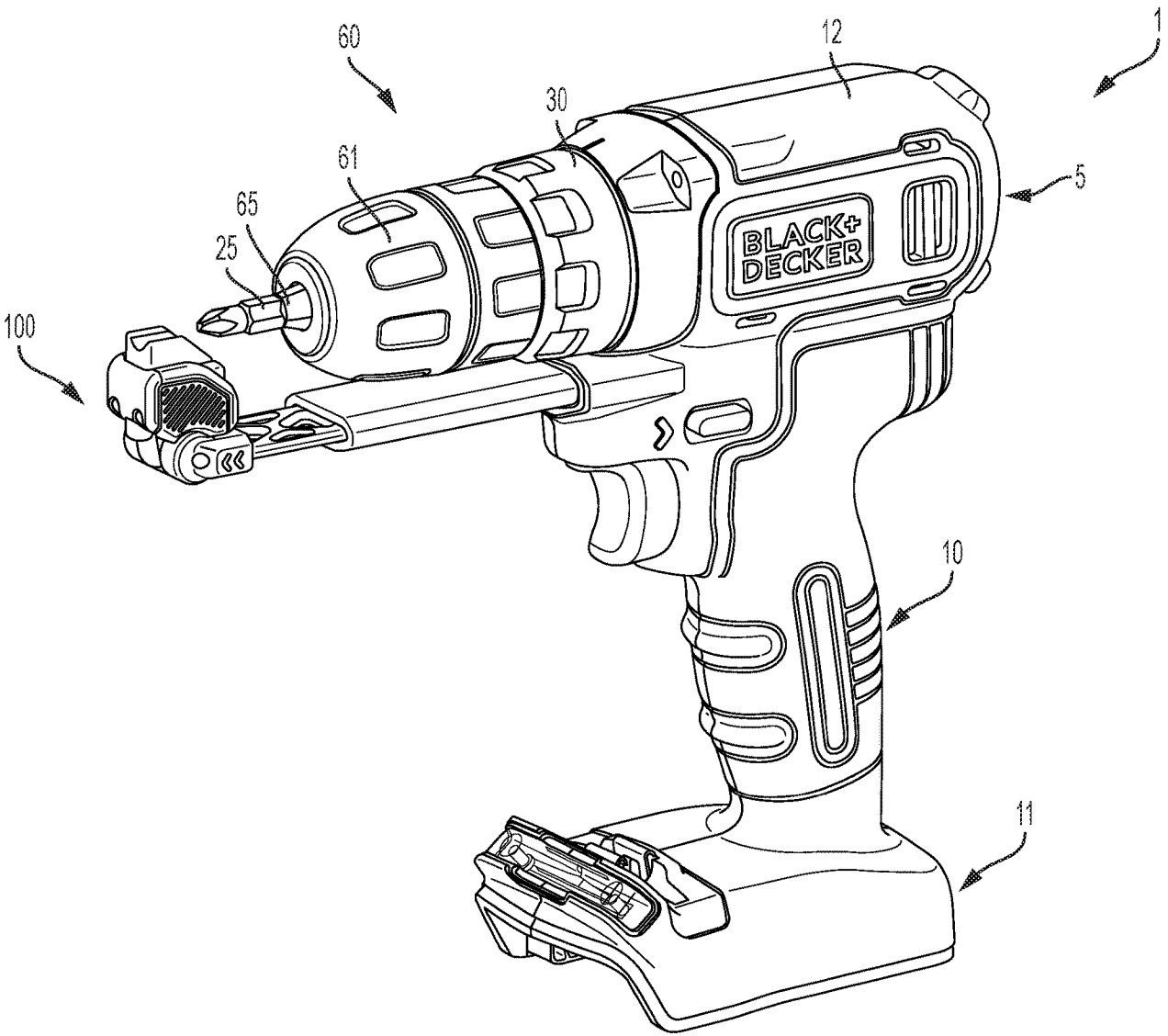
FIG. 1 is a perspective view of a drill with a screw and bit holder according to an exemplary embodiment.

An exemplary embodiment of the present application shown in FIGS. 1-17 discloses a drill 1 with a bit and screw holder assembly 100 which can hold a screw to be driven with the drill 1. As shown in FIGS. 1-5, the drill 1 includes a housing 5. The housing 5 forms a handle 10 which can be gripped by a user. A foot 11 is at one end of the handle 10 and is configured to receive a battery pack 300 (FIG. 11) which powers the drill 1. At the other end of the handle is a motor housing 12 which is a portion of the housing 5 which houses the motor 90 (FIGS. 5 and 7) is housed.

Figure 12:
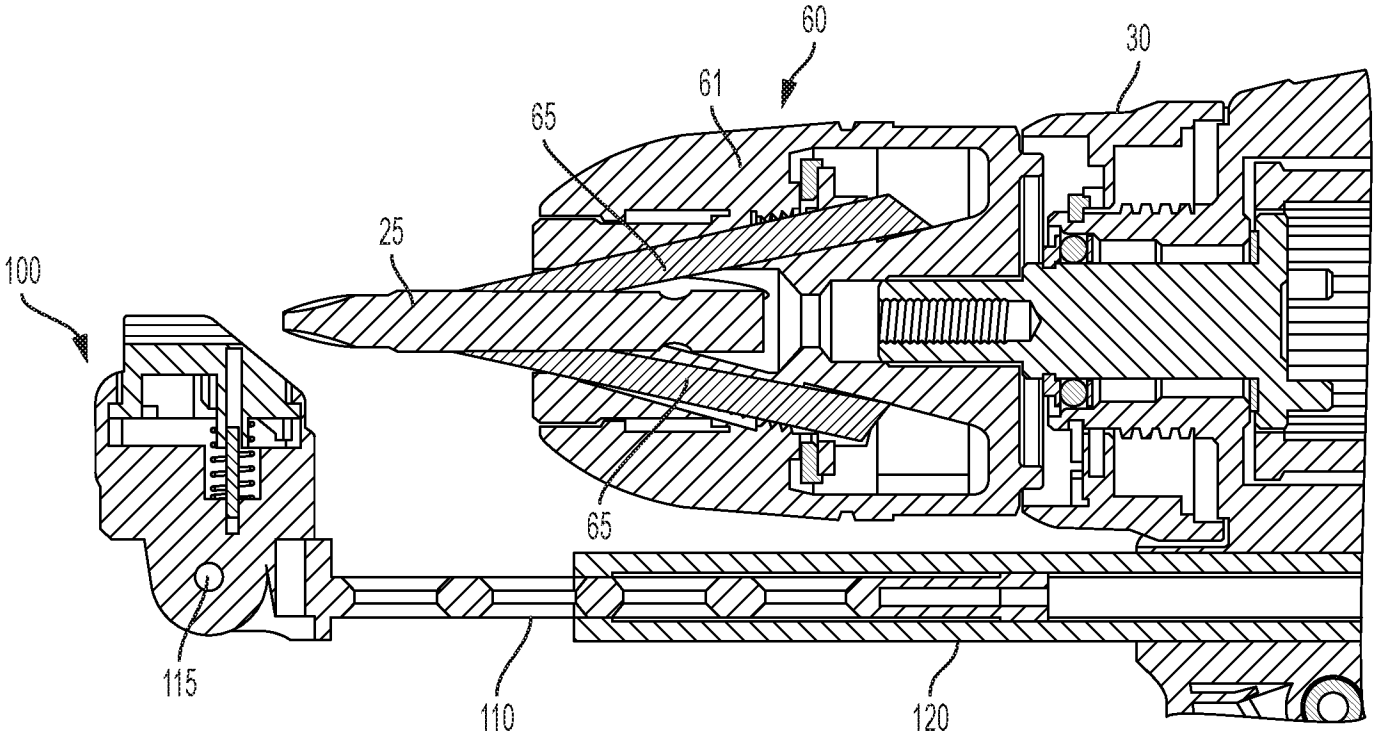
FIG. 12 is a cross-sectional side view of a portion of the drill of the exemplary embodiment.

The motor 90 drives a chuck 60 which includes three retractable jaws 65 which holds a bit 25. Since the chuck jaws 65 retract and extend, they can secure drill bits and screw bits of different sizes. A cross sectional view of the chuck 60 is shown in FIG. 12. As shown there, the chuck 60 has a sleeve 61 which can be rotated to advance or retract the chuck jaws 65. The chuck may also be of the type shown in, for example, US Patent Application Publication No. 2014/0262409, US Patent Application Publication No. 2006/0202435 and EP 0716896, each of which are herein incorporated by reference.

Figure 3:
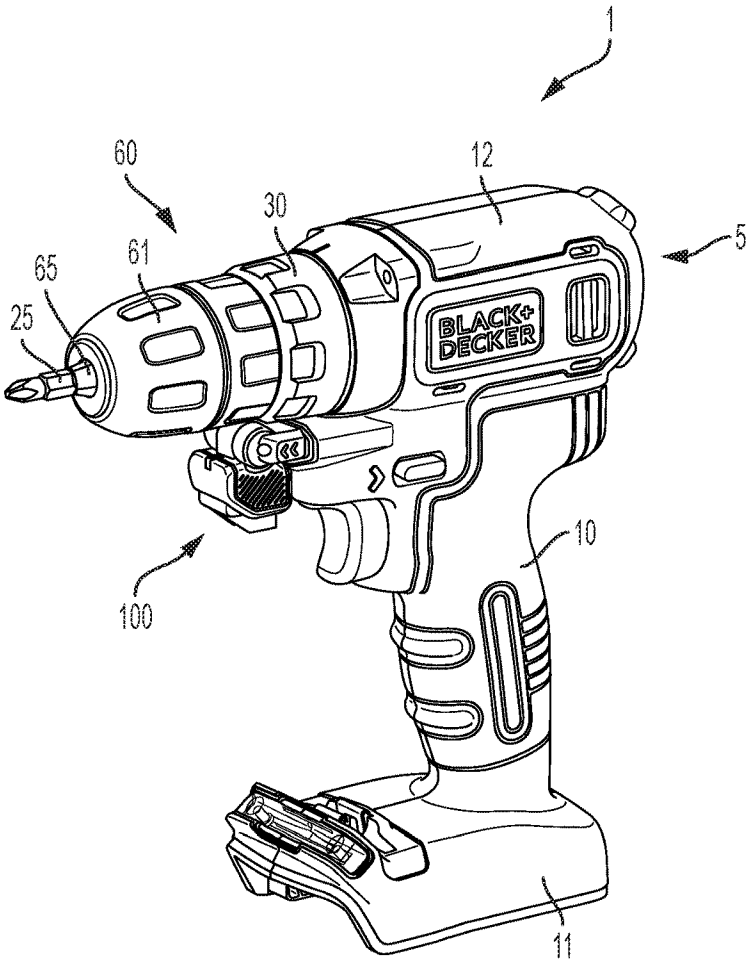
FIG. 3 is another perspective view of the drill of the exemplary embodiment.
Figure 2:
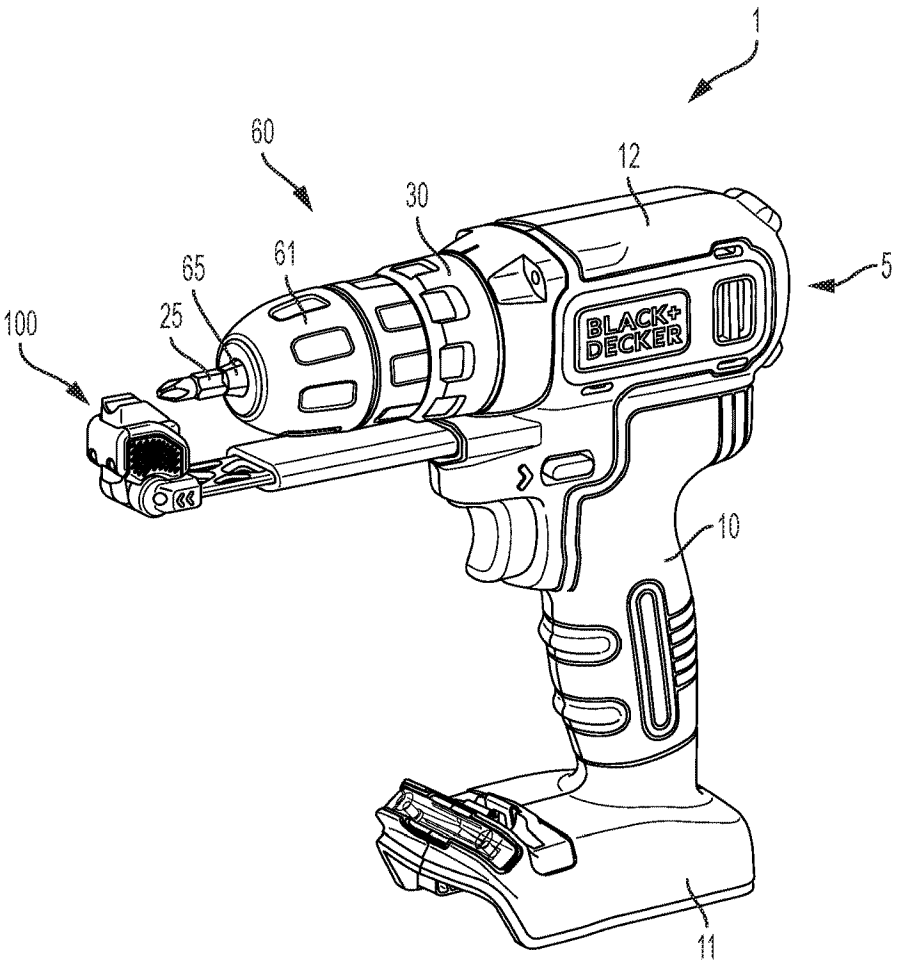
FIG. 2 is another perspective view of the drill of the exemplary embodiment.

As shown in FIGS. 1-3, the screw holder assembly 100 can be in an extended position, as shown in FIGS. 1 and 2, or in a retracted position, as shown in FIG. 3. When the screw holder assembly 100 is in the extended position, it is positioned to hold a screw which can be driven by the bit 25. The screw holder assembly 100 may also support a bit, such as a drill bit. In this instance, because the drill bit is supported by the screw holder assembly 100, it may aid a user in securing the bit in the chuck 60. In the retracted position, the screw holder assembly 100 is out of the way of a user of the drill 1.

Figure 6:
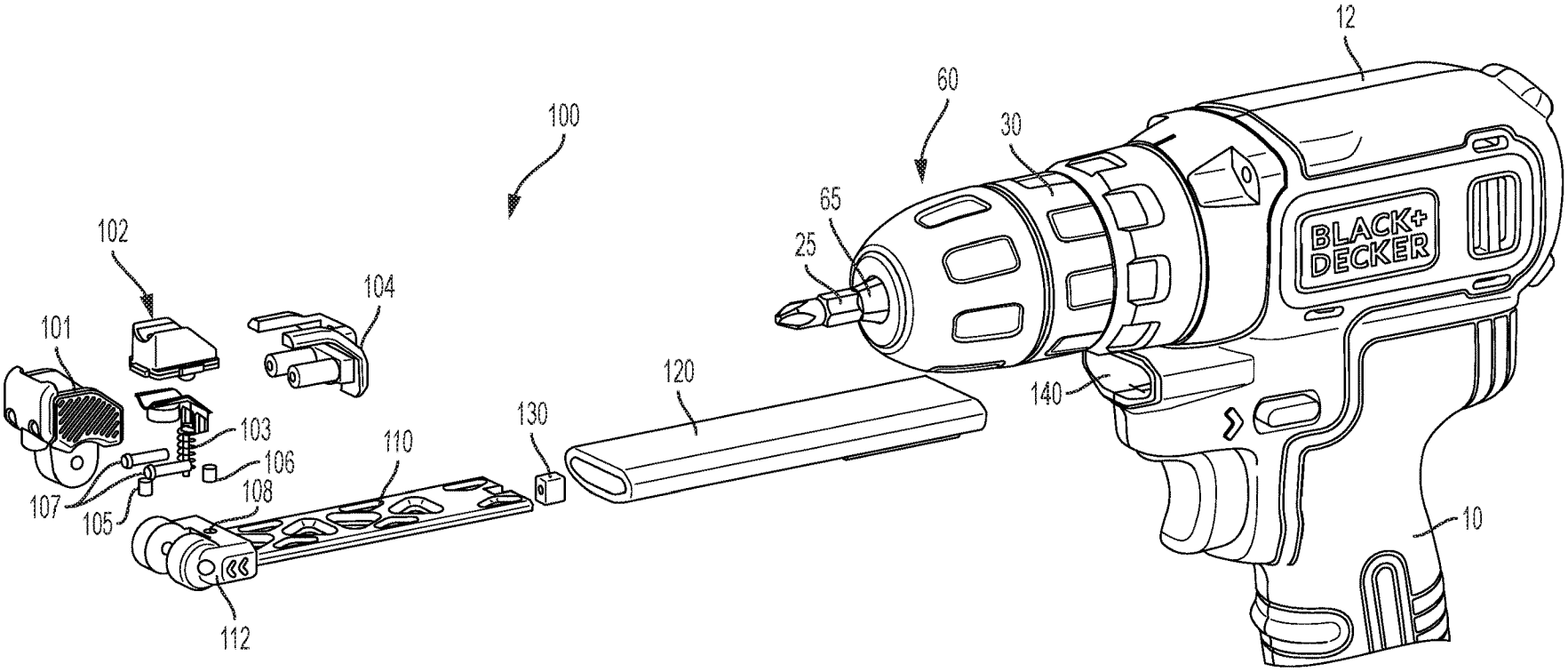
FIG. 6 is a perspective view of the drill of the exemplary embodiment with the screw holder assembly shown in exploded perspective.

An exploded drawing is shown in FIG. 6, which illustrates the parts of the screw holder assembly 100. The screw holder assembly 100 includes a leg portion 115 which includes an outer slider 120 and an inner slider 110. The inner slider 110 slides out of the outer slider 120. At the end of the inner slider 110, there is a bit holder body retaining member 112. The bit holder body 101 is rotatably connected to the bit holder body retaining member 112 by a pin 150 (see FIG. 5). The bit holder body 101 holds a magnetic bit holder 102. The magnetic bit holder 102 has a groove for holding a screw and is magnetic so as to secure a screw to in the groove with a magnetic force. The bit holder 102 is biased upwardly by a spring 103. A bit holder cover 104 hold the bit holder body 101 and magnetic bit holder 102 in place and is secured with screws 107. A pair of magnets 105 and 106 are disposed in the bit holder body 101, as will be discussed later. FIG. 6 also shows an inner slider stop 130. As shown in FIG. 6, the drill 1 further includes a receiving opening 140 for receiving the screw holder assembly 100.

Figure 7:
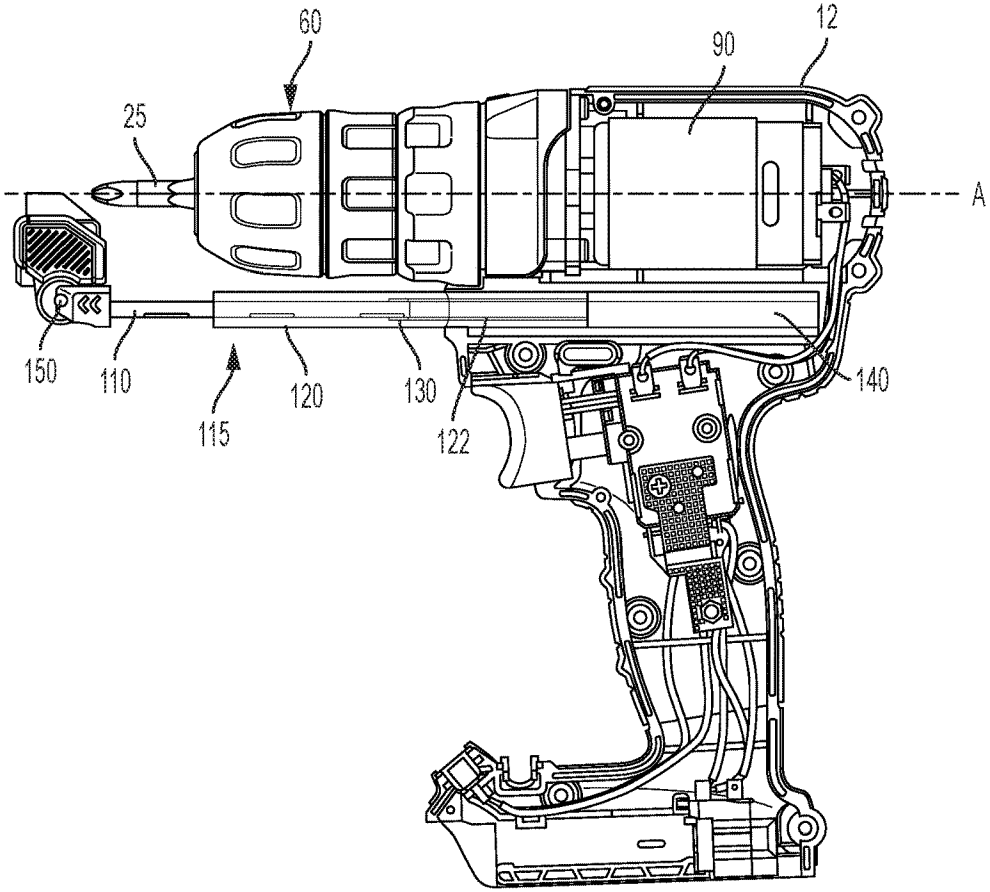
FIG. 7 is another side view of the drill of the exemplary embodiment with one housing half removed and the outer slider shown in shadow.

Retraction of the screw holder assembly 100 will now be explained with reference to FIGS. 7-10. FIG. 7 illustrates the screw holder assembly 100 in an extended position and the outer slider 120 in shadow. As shown in FIG. 7, the receiving opening 140 extends through the majority of the length of the drill 1. As shown, the outer slider 120 extends out of the opening 140 and the inner slider 110 extends from the outer slider 120.

Figure 8:
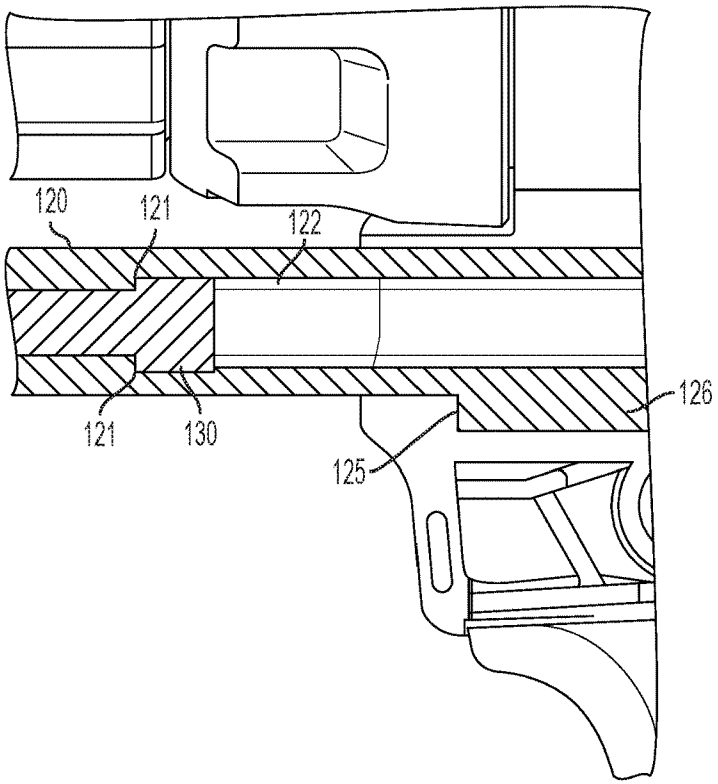
FIG. 8 is a close-up side view of a portion of the drill of the exemplary embodiment with one housing half removed and the outer slider shown in shadow.

As shown in close-up in FIG. 8, the outer slider has an inner groove 122 running partway through the outer slider 120. The inner groove 122 provides a larger opening than the remainder of the outer slider 120. The inner slider 110 includes an inner slider stop 130 which is fixedly attached to the inner slider 110. The inner slider stop 130 is sized so that it can slide in the groove 122. Accordingly, the inner slider 110 can extend until the groove 122 of the outer slider 120 runs out. In a fully extended position, the inner slider stop 130 contacts a shoulder 121 of the groove 122. Once the inner slider stop 130 reaches the shoulder 121, the inner slider 110 cannot be extended any further because the contact between the shoulder 121 and the stop 130 prevents further extension.

As shown in FIG. 8, the outer slider 120 also includes a stopping mechanism. In particular, the outer slider 120 includes an outer slider stop 126 which is a portion of the outer slider 120 extending below the rest of the slider. The outer slider 120 can be extended until the outer slider stop 126 hits a shoulder 125 of a housing of the drill 1. Once the outer slider stop 126 hits the shoulder 125, contact between the outer slider stop 126 and the shoulder 125 prevents further extension.

Figure 10:
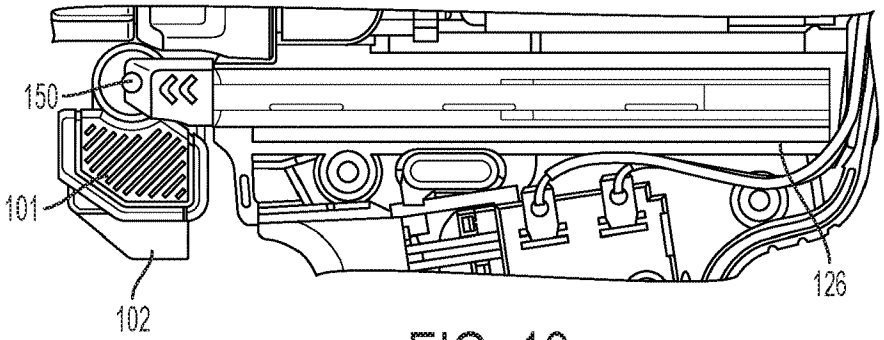
FIG. 10 is a close-up side view of a portion of the drill of the exemplary embodiment with one housing half removed and the outer slider shown in shadow.
Figure 9:
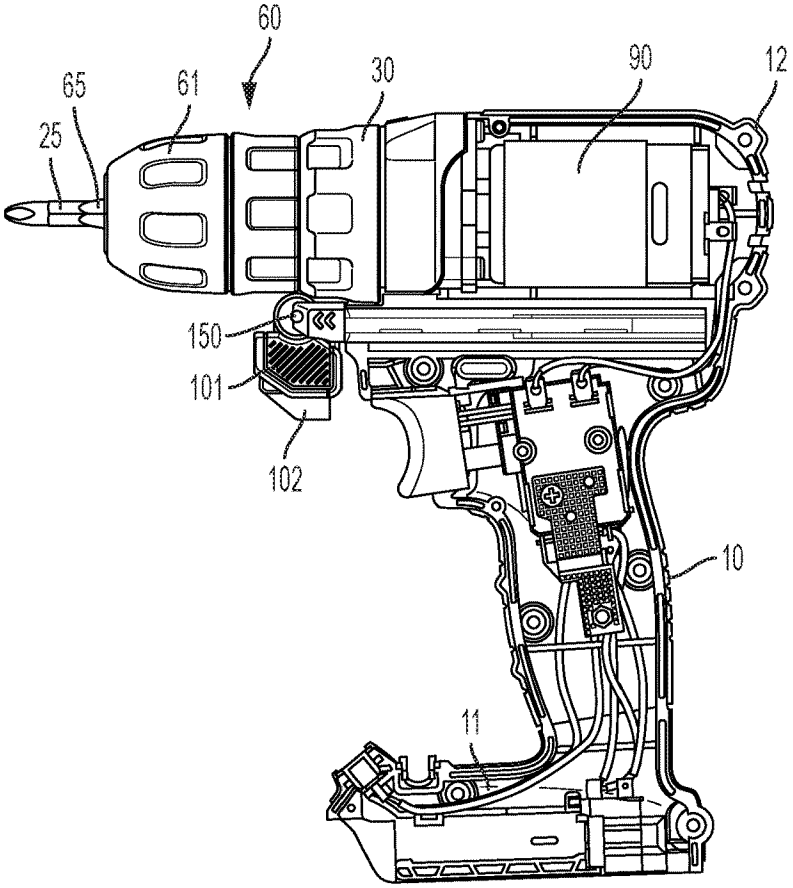
FIG. 9 is another side view of the drill of the exemplary embodiment with one housing half removed and the outer slider shown in shadow.

FIGS. 9 and 10 show the screw holder assembly 100 in a retracted position. FIG. 9 illustrates the drill with one housing half removed and illustrates the outer slider 120 in shadow to illustrate the inner slider 110. FIG. 10 is a close-up view of the retracted inner and outer sliders 110, 120. As shown in FIGS. 9 and 10, the inner slider 110 retracts to a position inside the outer slider 120. The outer slider 120 and inner slider 110 both retract into the opening 140 in the housing. In this way, the screw holder assembly 100 is stored in the housing 5 of the drill.

As is additionally shown in FIGS. 9 and 10, when the screw holder assembly 100 is in the stored position, the bit holder body 101 and magnetic bit holder 102 rotate about the pin 150. This allows the bit holder body and magnetic bit holder to move out of the way of the chuck 60 and towards the rest of the drill 1. As can be seen, the bit holder body 101 and magnetic bit holder 102 rotate about an axis that is generally perpendicular to the rotational axis A of the motor 90 and chuck 60.

Figure 4B:
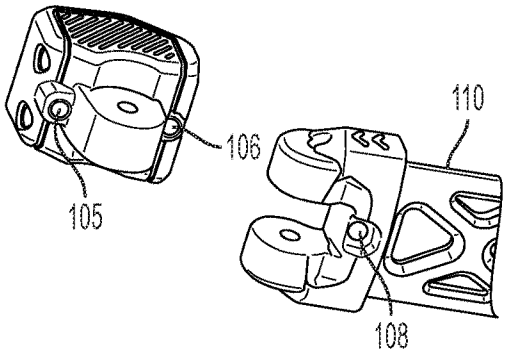
FIG. 4B is an exploded perspective view of a portion of a screw holder assembly according to the exemplary embodiment.
Figure 4C:
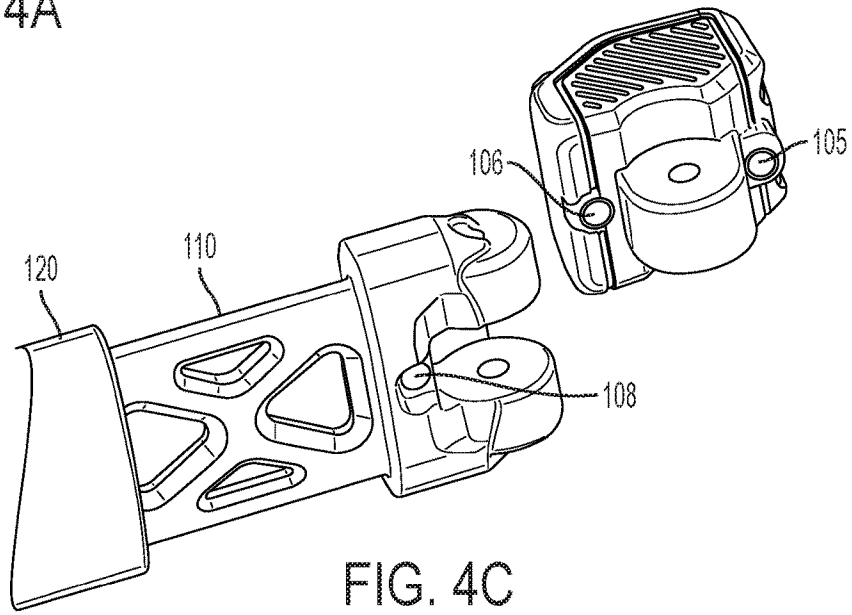
FIG. 4C is an exploded perspective view of a portion of a screw holder assembly according to the exemplary embodiment.
Figure 4A:
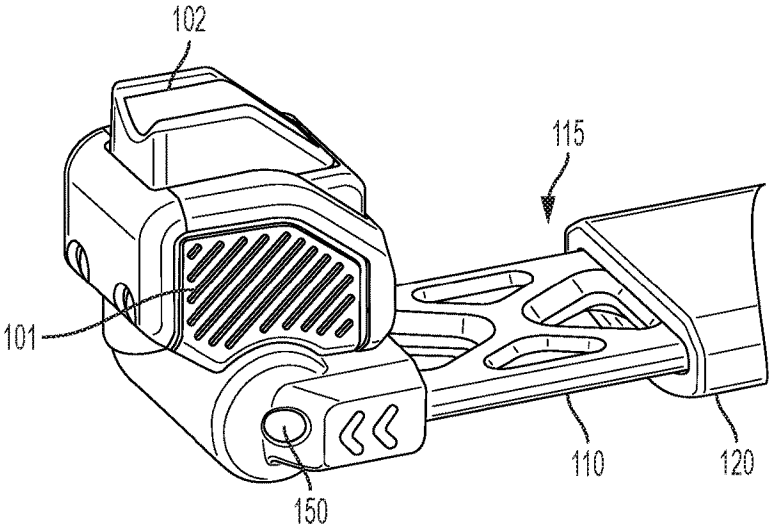
FIG. 4A is a perspective view of a portion of a screw holder assembly according to the exemplary embodiment.

A detailed view of the connection of the holder body 101 and holder 102 is shown in FIGS. 4A through 4F. In FIG. 4A, the holder body 101 and holder 102 are shown in a position for holding a screw or bit. FIGS. 4 B and 4C show the holder body 101 and holder 102 separated from the leg 115, for illustrative purposes. As shown in FIGS. 4B and 4C, the holder body 101 includes a front magnet 105 and a rear magnet 106. Additionally, the inner slider 110 has a leg magnet 108 at its end. When the holder body 101 is in the position shown in FIG. 4A, the rear magnet 106 is aligned with the leg magnet 108. Attraction between the rear magnet 106 and leg magnet 108 holds the holder body 101 in position. That is, it prevents the holder body 101, and thus the holder 102 attached thereto, from rotating unless acted upon by a force sufficient to overcome the magnetic attraction force.

Figure 4E:
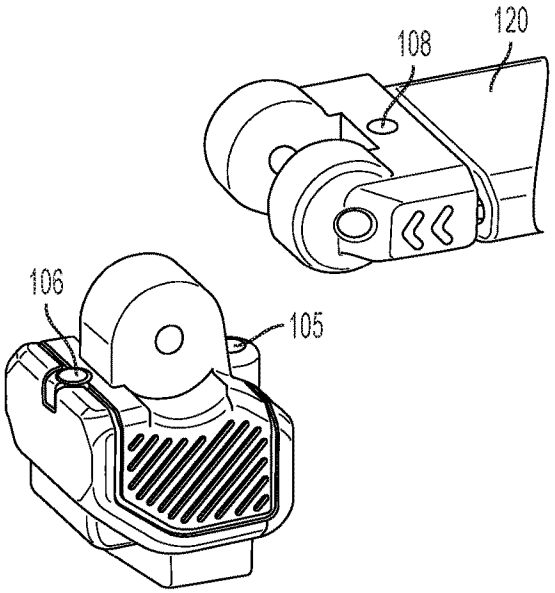
FIG. 4E is an exploded perspective view of a portion of a screw holder assembly according to the exemplary embodiment.
Figure 4F:
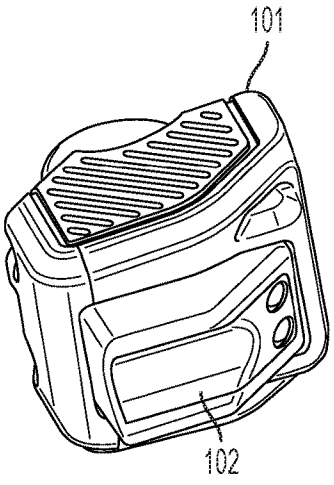
FIG. 4F is an exploded perspective view of a portion of a screw holder assembly according to the exemplary embodiment.
Figure 4F:
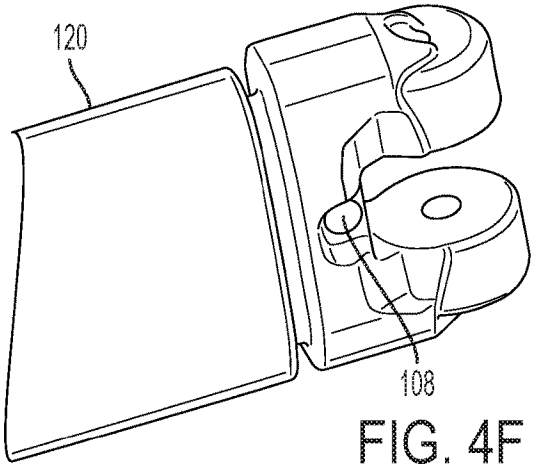
Figure 4D:
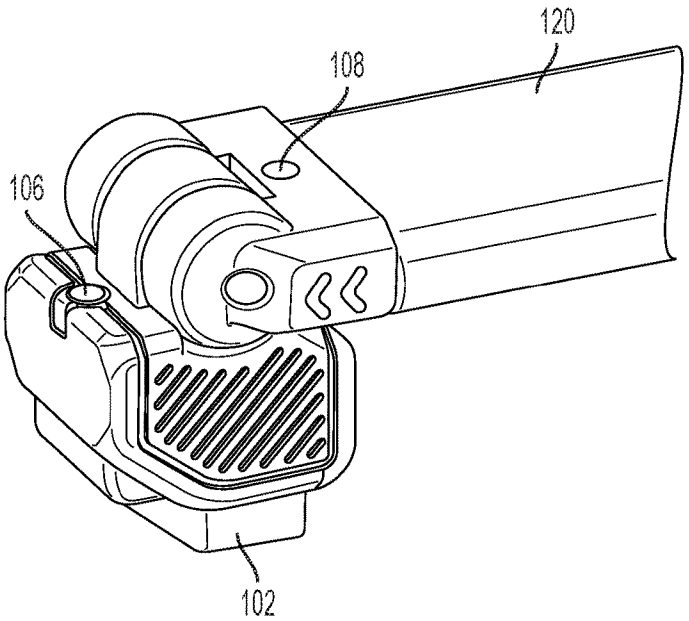
FIG. 4D is a perspective view of a portion of a screw holder assembly according to the exemplary embodiment.
Figure 5:
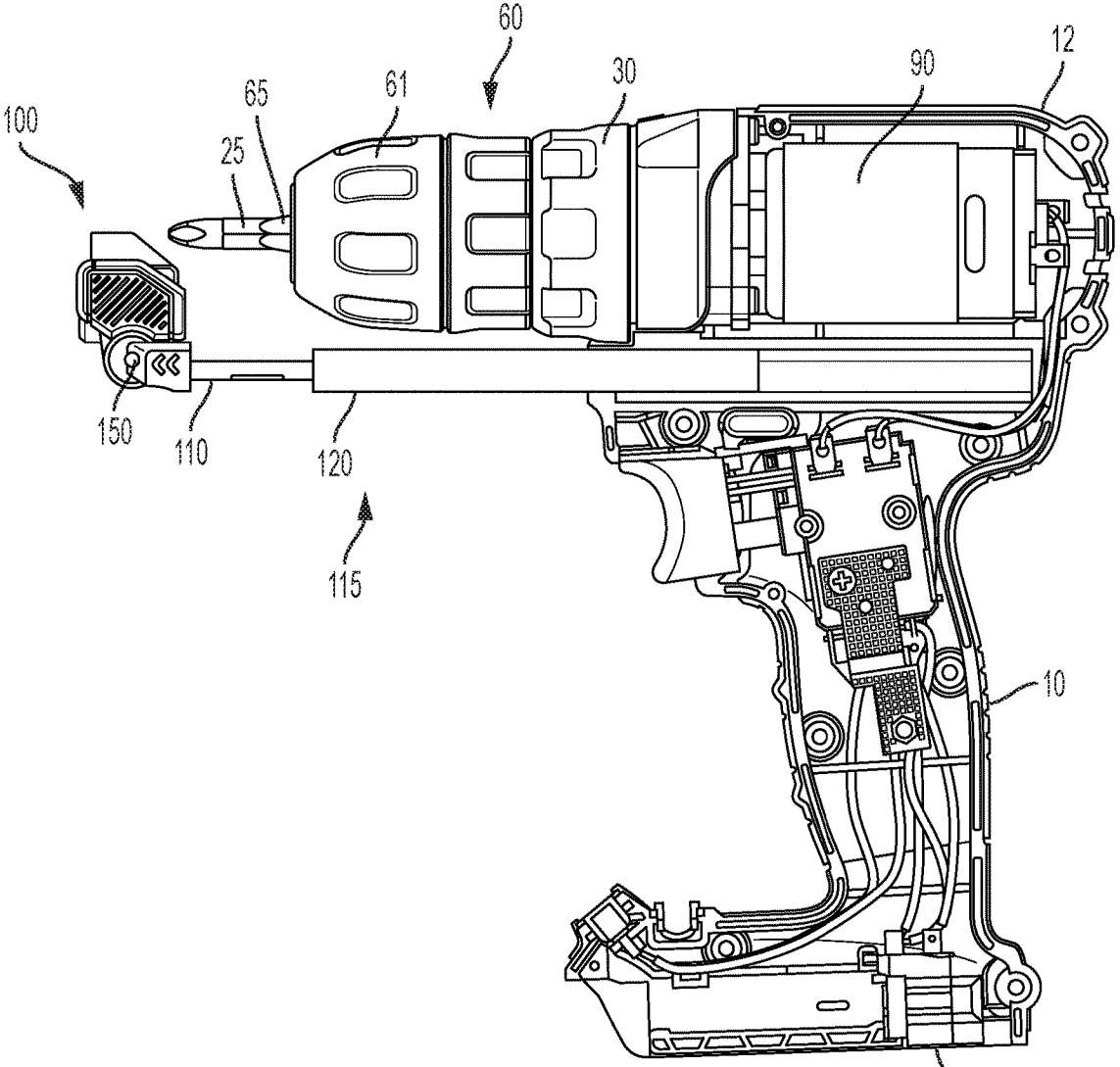
FIG. 5 is a side view of the drill of the exemplary embodiment with one housing half removed.

In FIG. 4D, the holder body 101 and holder 102 are shown in the downward position corresponding to FIGS. 9 and 10. FIGS. 4E and 4F show the holder body 101 and holder 102 separated from the leg 115, for illustrative purposes. When the holder body 101 is in the position shown in FIG. 4D, the front magnet 105 is aligned with the leg magnet 108. Thus, attraction between the front magnet 105 and leg magnet 108 holds the holder body 101 in the retracted position shown in FIGS. 4D, 9 and 10.

The holder body 101 and holder 102 can be moved from the work position of FIGS. 1 and 2 to the storage position of FIG. 3 by a user rotating the holder body 101 and holder 102. Alternatively, as the holder assembly 100 is slid back, the holder 102 and holder body 101 will contact the chuck 60 and that will force the holder 102 and body 101 to rotate into the storage position shown in FIG. 3.

Figure 11:
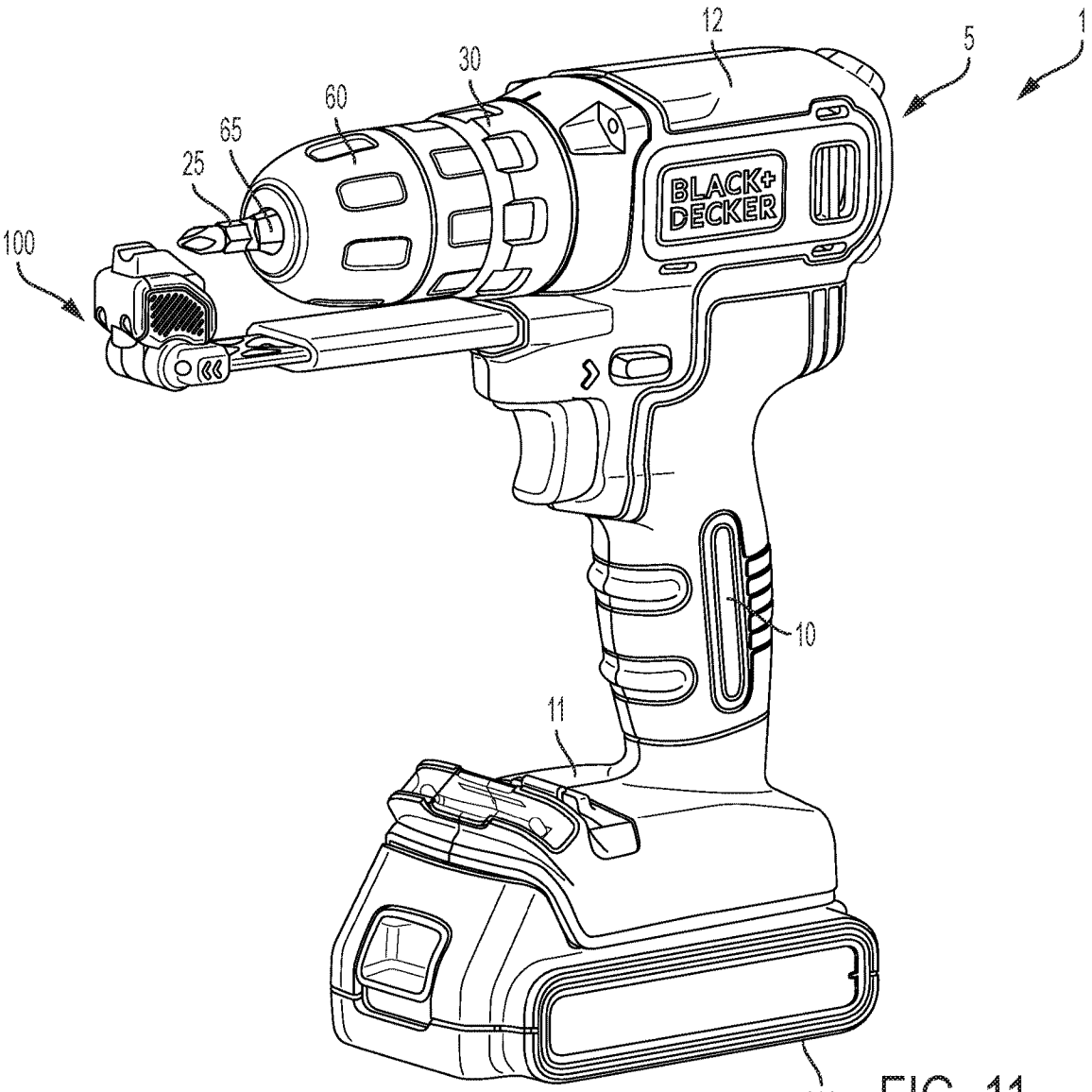
FIG. 11 is another perspective view of the drill of the exemplary embodiment with a battery pack.
Figure 14:
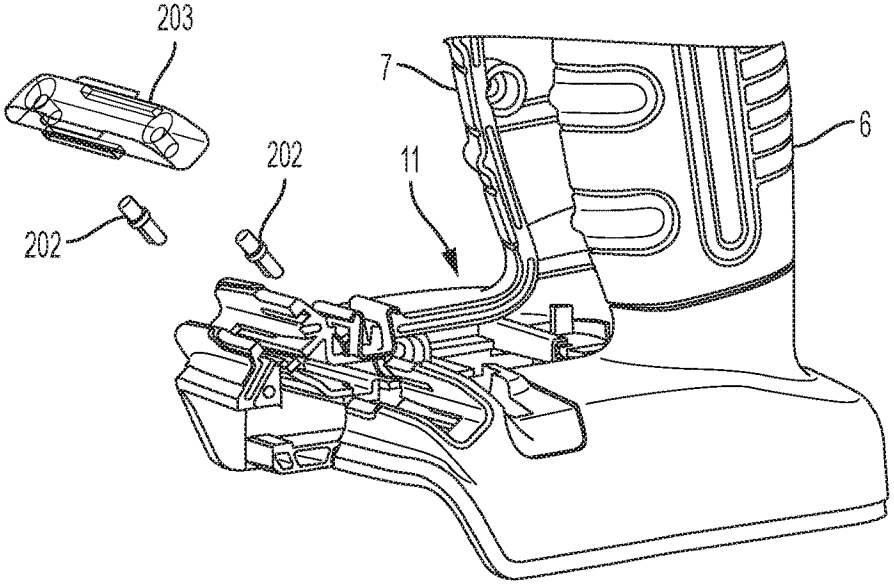
FIG. 14 is an exploded perspective view of the foot portion of the drill of the exemplary embodiment.
Figure 13:
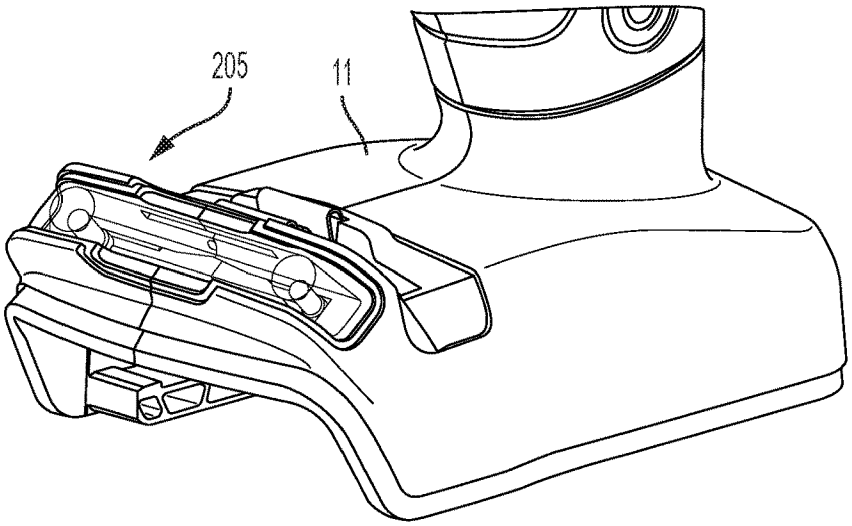
FIG. 13 is a perspective view of a foot portion of the drill of the exemplary embodiment.
Figure 15:
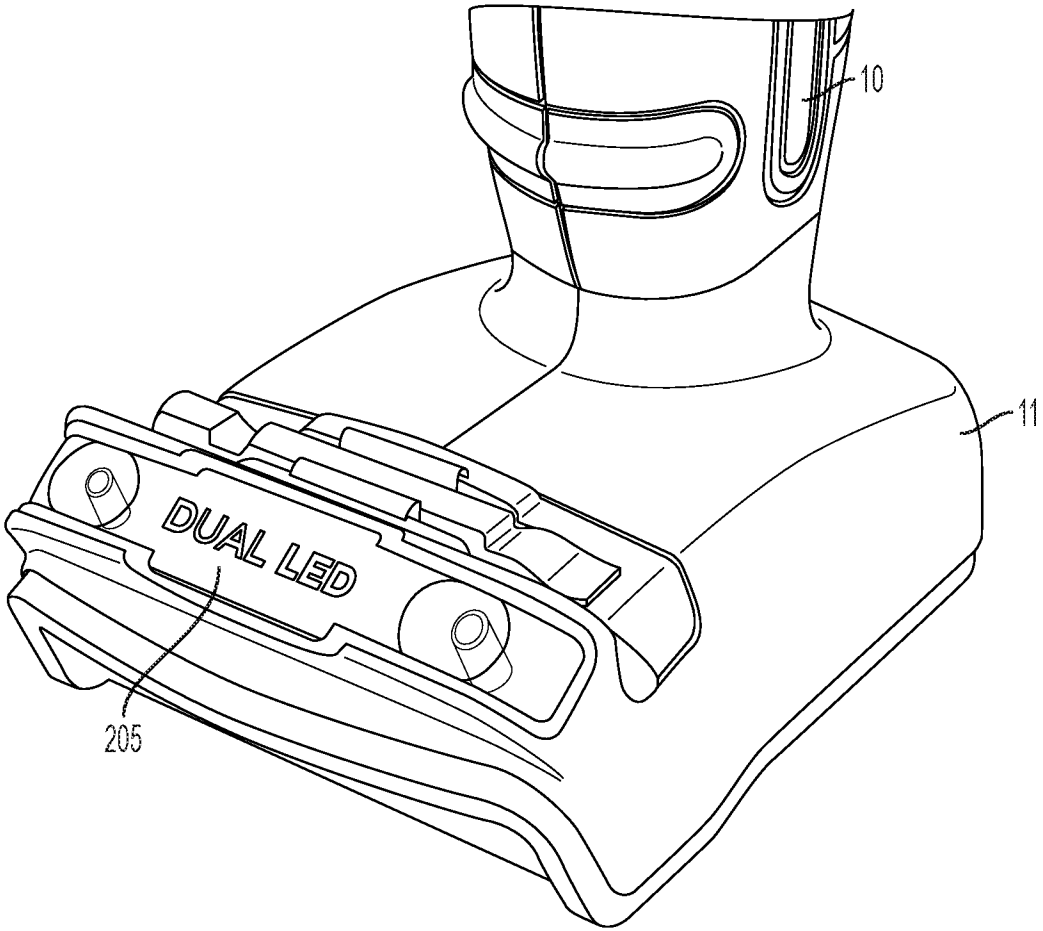
FIG. 15 is another perspective view of the foot portion of the drill of the exemplary embodiment.
Figure 16:
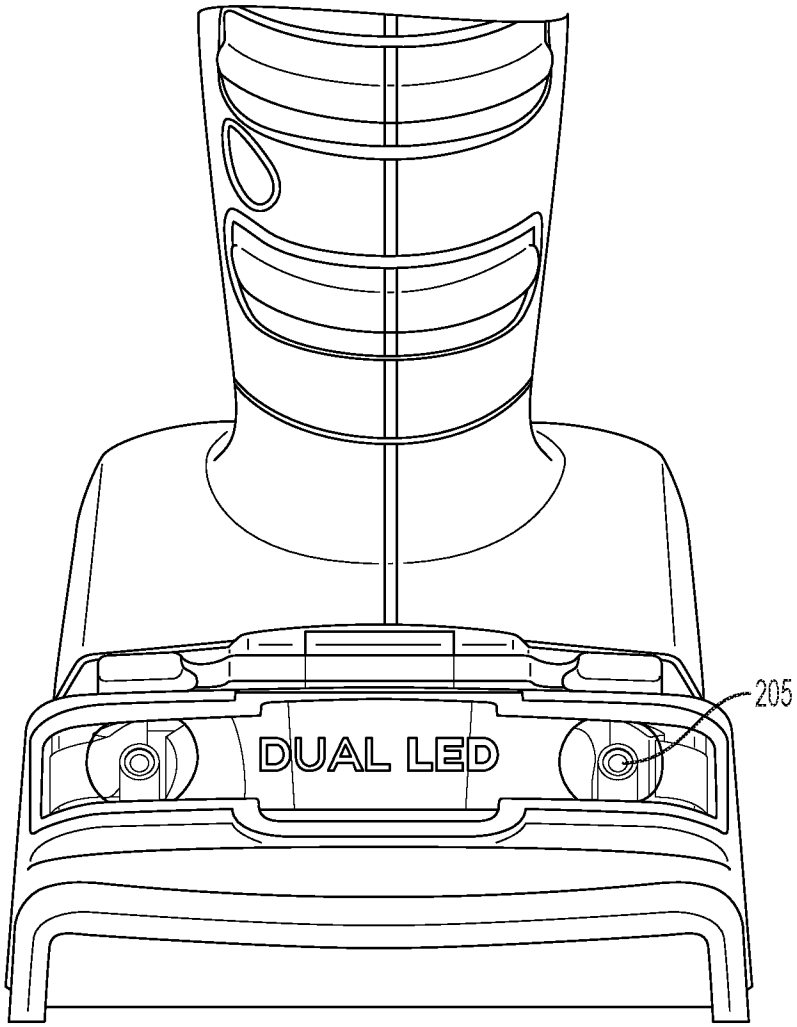
FIG. 16 is a front perspective view of the foot portion of the drill of the exemplary embodiment.
Figure 17:
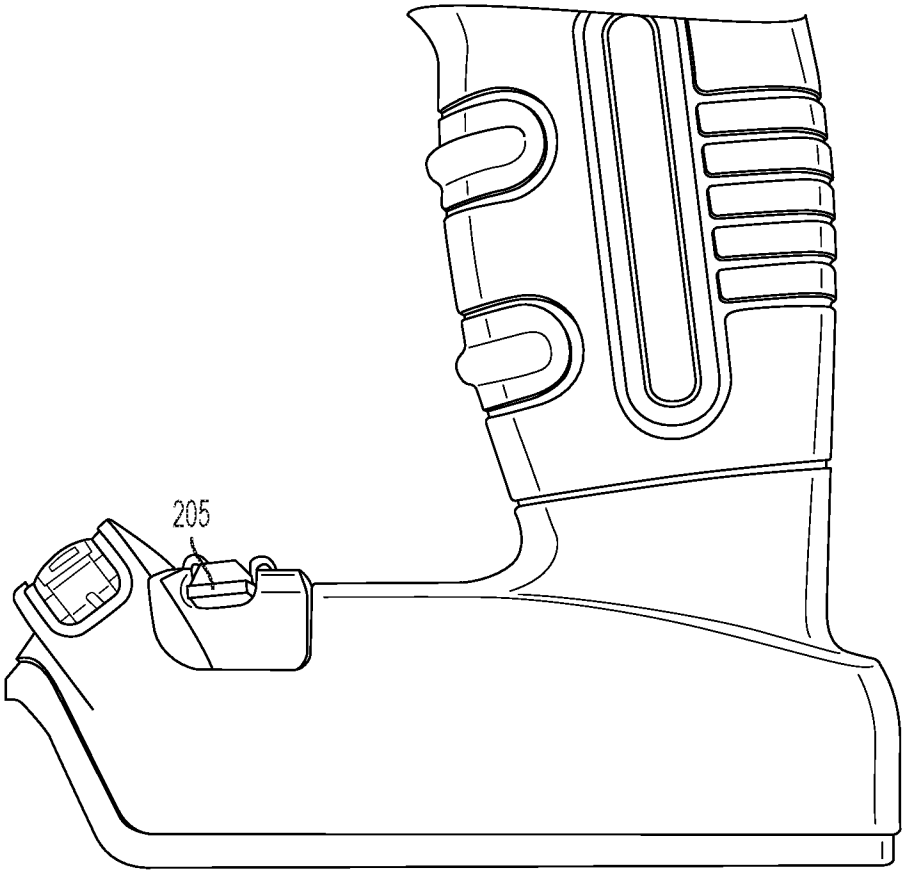
FIG. 17 is a side view of the foot portion of the drill of the exemplary embodiment.

As shown in FIG. 11, the drill 1 is powered by a battery pack 300 which is connected to the foot portion 11. As shown in FIGS. 13-17, the drill 1 may also include an LED assembly 205 located at the foot portion 11. FIG. 14 shows an exploded view. The housing 5 is comprised of two housing halves 6 and 7. The LED assembly 205 includes a pair of LEDs 202 and a lens cover 203. The LEDs 202 and lens 203 point upwardly towards a point where the drill 1 would do work on a workpiece.

While the invention has been described by way of exemplary embodiments, it is understood that the words which have been used herein are words of description, rather than words of limitation. Changes may be made within the purview of the appended claims, without departing from the scope and spirit of the invention in its broader aspects.

What is claimed is:

1. A power tool, comprising:

a housing;

a motor disposed in the housing;

an output member, the output member being drivable by the motor;

a holder assembly, the holder assembly including a leg portion extending from the housing and a holder configured to hold a fastener;

wherein the holder is rotatable about an axis substantially perpendicular to a rotational axis of the output member;

wherein the holder is rotatable relative to the leg portion of the holder assembly;

wherein the holder assembly is movable from a working position in which the leg portion extends from the housing and the holder is disposed in a position in which it is configured to hold the fastener in a position to be driven by a bit held by the output member to a stored position in which the leg portion is slid into the housing;

wherein the power tool further comprises a trigger; and wherein when the holder assembly is in the stored position the holder is adjacent to the trigger.

2. The power tool of claim 1, wherein the output member comprises a chuck with a plurality of retractable jaws.

3. The power tool of claim 1, wherein the chuck is configured to hold screwdriver bits and drill bits of different sizes.

4. The power tool of claim 1, wherein the housing includes a cavity into which the leg is slideable.

5. The power tool of claim 1, wherein the leg includes an outer slider and an inner slider, the inner slider configured to be slideable into the outer slider.

6. The power tool of claim 1, wherein the holder is disposed at an end of an inner slider.

7. The power tool of claim 1, wherein the holder includes a longitudinally extending groove.

8. The power tool of claim 1, wherein the holder is biased by a biasing member.

* * * * *